US010217580B1

(12) United States Patent
Blain et al.

(10) Patent No.: US 10,217,580 B1
(45) Date of Patent: Feb. 26, 2019

(54) SYSTEMS AND METHODS FOR RESTRAINING A MOVABLE SWITCH BLADE OF A DISCONNECT SWITCH

(71) Applicants: Larry Edward Blain, Moody, AL (US); Frank Joseph Kelly, Moody, AL (US)

(72) Inventors: Larry Edward Blain, Moody, AL (US); Frank Joseph Kelly, Moody, AL (US)

(73) Assignee: TCI Sales, Inc., Moody, AL (US)

( * ) Notice: Subject to any disclaimer, the term of this patent is extended or adjusted under 35 U.S.C. 154(b) by 0 days.

(21) Appl. No.: 14/836,542

(22) Filed: Aug. 26, 2015

Related U.S. Application Data

(60) Provisional application No. 62/042,119, filed on Aug. 26, 2014.

(51) Int. Cl.
*H01H 31/28* (2006.01)

(52) U.S. Cl.
CPC ..... *H01H 31/28* (2013.01); *H01H 2031/286* (2013.01)

(58) Field of Classification Search
CPC ..... H01H 31/28; H01H 2031/286; H02B 5/00
USPC ..... 200/48 A; 361/602
See application file for complete search history.

(56) References Cited

U.S. PATENT DOCUMENTS 3,299,240 A * 1/1967 Foti ..... H01H 1/5833 200/254
4,432,420 A * 2/1984 Gregory ..... E21B 19/09 166/355
2005/0052801 A1 3/2005 Ghali
2014/0062196 A1 3/2014 Wijekoon et al.
2014/0071592 A1 3/2014 Phillips

OTHER PUBLICATIONS

"Purpose of Disconnect Switches in HV Substation", http://electrical-engineering-portal.com/purpose-of-disconnect-switches-in-hv-substation, Aug. 26, 2015.

* cited by examiner

*Primary Examiner* — Renee S Luebke
*Assistant Examiner* — Iman Malakooti
(74) *Attorney, Agent, or Firm* — Maynard Cooper & Gale, P.C.; Jon E. Holland

(57) ABSTRACT

A restraint system is used to restrain a movable switch blade of a disconnect switch in order to prevent accidental closure of the switch blade. In this regard, the restraint system has a sheath that is positioned over an end of the switch blade, and the sheath is tethered to a support structure so that tension in the tether resists movement of the switch blade toward a conductive jaw. Thus, current is prevented from flowing through the disconnect switch until the sheath is manually removed from the switch blade.

8 Claims, 6 Drawing Sheets

SYSTEMS AND METHODS FOR RESTRAINING A MOVABLE SWITCH BLADE OF A DISCONNECT SWITCH

CROSS REFERENCE TO RELATED APPLICATION

This application claims priority to U.S. Provisional Patent Application No. 62/042,119, entitled "Systems and Methods for Restraining a Movable Switch Blade of a Disconnect Switch" and filed on Aug. 26, 2014, which is incorporated herein by reference.

RELATED ART

Within a power distribution system, conventional disconnect switches are used in electrical substations for selectively controlling transmission of electrical current through the substations. Such a switch has a conductive arm, referred to as "switch blade," that is rotatable into open and closed positions. When in a closed position, an end of the switch blade makes contact with a conductive jaw for enabling transfer of electrical current through the switch. When desired, the switch blade can be rotated to an open position such that it is separated from the jaw, thereby preventing current from flowing through the switch. When users are at a substation performing maintenance, repairs, or other work, a user often rotates the switch blade to an open position in order to ensure that the flow of current is prevented for safety reasons. Once the work is completed, the switch blade can be rotated back to the closed position to again allow the flow of current.

While work is being performed at the substation, it is important to ensure that the switch blade stays sufficiently separated from the conductive jaw in order to prevent accidental contact of the blade with the jaw and to prevent arcing between the blade and the jaw. Otherwise, serious bodily injury could occur from the unexpected flow of electrical current through the switch. For this reason, conventional disconnect switches often have a locking mechanism that prevents the switch from closing once the blade is moved to the open position until a user activates the locking mechanism for closing the switch. However, if the locking mechanism fails or is not operated correctly, the switch blade could accidentally move close enough to the conductive jaw to permit current flow possibly risking serious bodily injury to the users at the substation. Improved techniques for ensuring electrical separation of the switch blade and the conductive jaw are generally desired.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to systems and methods for restraining an arm of an electrical substation disconnect switch. In one exemplary embodiment, a disconnect switch has an arm, referred to as "switch blade," that sits high atop porcelain insulators, and the switch blade is movable to a vertical open position where the blade is electrically isolated from an opposing conductive jaw. In the vertical open position, the blade is subject to accidental engagement with the opposing conductive jaw due to winds and gravity. Also, the switch blade may inadvertently engage with the opposing conductive jaw as a result of a faulty locking mechanism for a hinge that is coupled to the switch blade. In such case, gravitational pull on the switch blade can cause it to drop and engage electrically with the conductive jaw, thereby allowing current to flow through the disconnect switch.

In one exemplary embodiment, a restraint system is used to prevent accidental engagement of the switch blade with the conductive jaw. In this regard, the restraint system has a removable sheath that is positioned over an end of the switch blade, and the sheath is tethered to a support structure so that tension in the tether resists movement of the switch blade toward the conductive jaw. Thus, even if the locking mechanism associated with the hinge fails, the restraint system keeps the switch blade sufficiently far from the conductive jaw so that current flow through the disconnect switch is prevented. When engagement of the switch blade with the conductive jaw is desired, the sheath is removed from the end of the switch blade so that the blade is free to rotate toward the conductive jaw.

Figure 1:
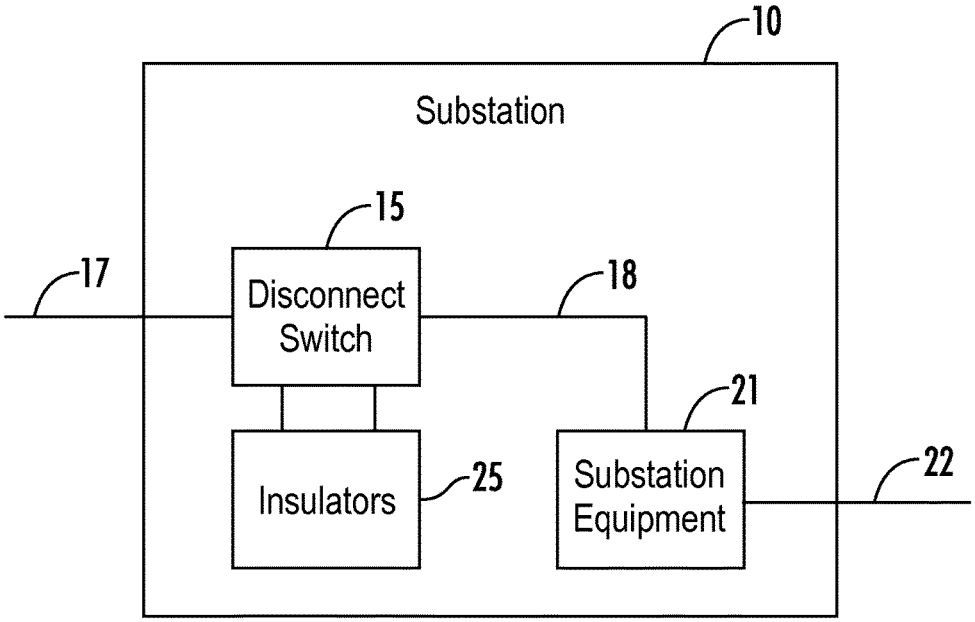
FIG. 1 (PRIOR ART)
FIG. 1 is a block diagram illustrating conventional disconnect switch at an electrical substation of a power distribution system.

FIG. 1 depicts an electrical substation 10 having a disconnect switch 15 that is coupled to a power transmission line 17 for carrying high-voltage power signals across large distances (e.g., several miles). In one exemplary embodiment, the transmission line 17 is capable of carrying a range of current from about 250 amperes (A) to about 4000 A, for example, at about 2000 volts (V) to about 230 kilo-volts (kV) or more, though other currents and voltages are possible in other embodiments.

As shown by FIG. 1, the disconnect switch 15 is coupled to a power transmission line 18 that carries current between the disconnect switch 15 (when in the closed position) and electrical substation equipment 21, such as transformers and other electrical equipment typically found at substations 10. Current may be carried from the substation equipment 21 via one or more power transmission lines 22 to homes, businesses, or other substations 10.

When in the closed position, current flows through the disconnect switch 15 such that electrical power is transferred from the power transmission line 17 to the substation equipment 21. There are times when it is desirable for the disconnect switch 15 to be transitioned to an open position such that current is prevented from flowing through the switch 15. For example, when maintenance, repairs, or other work is being performed on the substation equipment 21, it is desirable for the disconnect switch 15 to be in the open position in order to protect of the workers at the substation 10 from electrical shock. If the disconnect switch 15 advertently closes allowing current to flow through the switch 15, there is an increased risk of serious bodily injury to the workers who may unaware of the switch closure.

In order to help protect workers and other users from electrical shock and severe injury, the switch 15 is often raised above the ground on insulators 25. A worker often uses an elongated pole in order to access a switch blade (not shown in FIG. 1) of the disconnect switch 15 for transitioning this blade between open and closed positions as may be desired.

Figure 2:
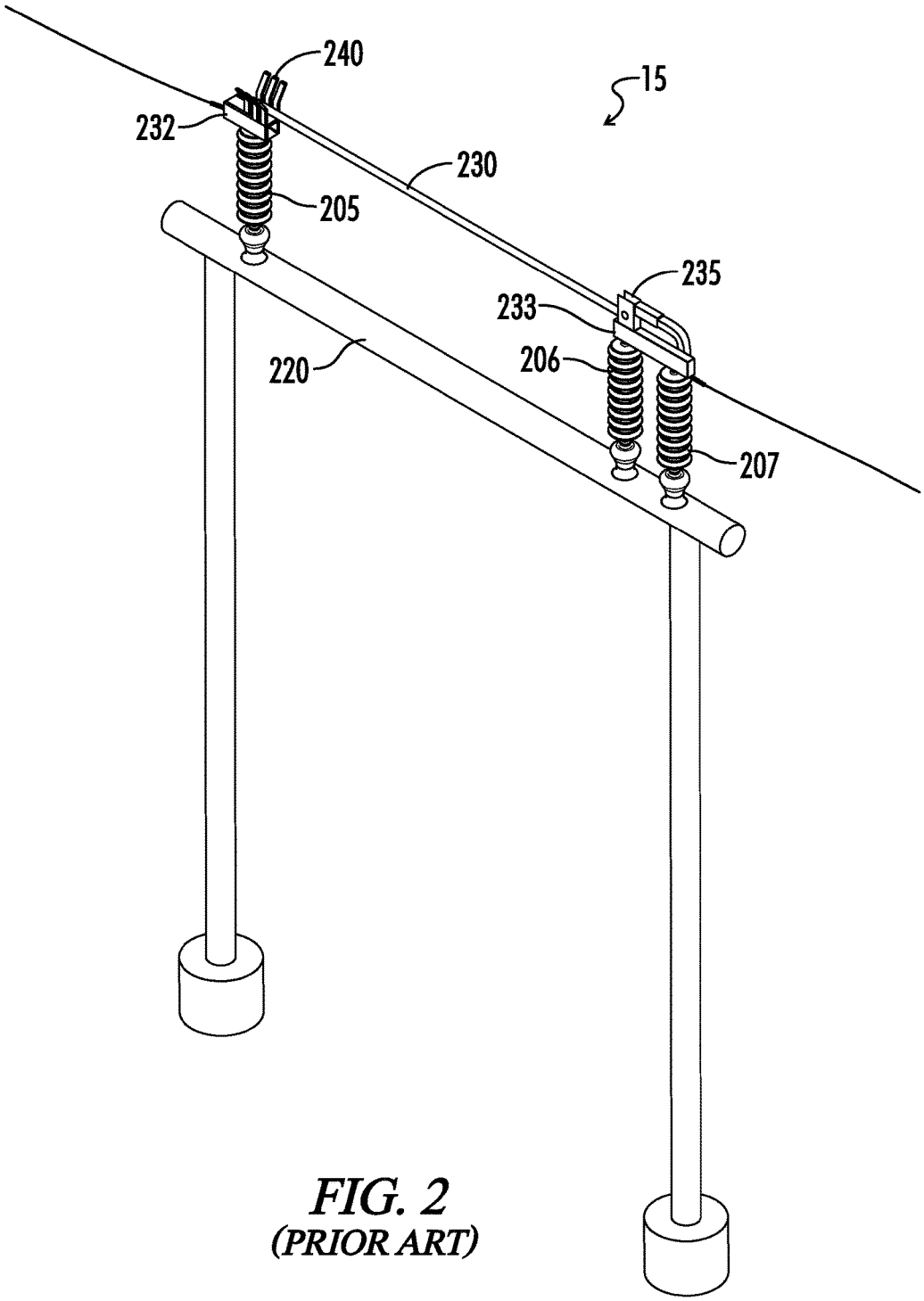
FIG. 2 (PRIOR ART)
FIG. 2 is a perspective view illustrating a conventional disconnect switch, such as is depicted by FIG. 1, when a switch blade of the disconnect switch is in a closed position.
Figure 3:
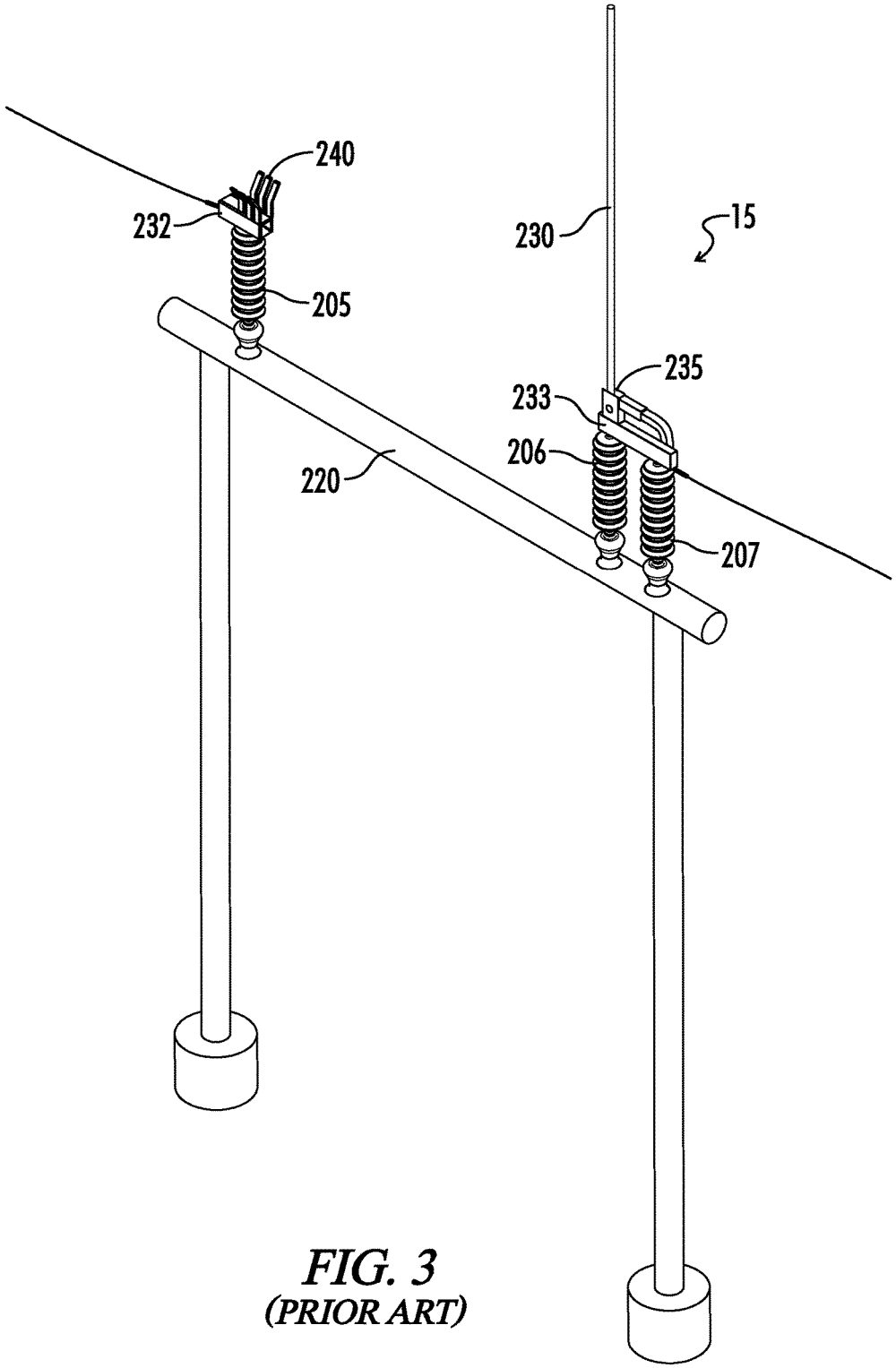
FIG. 3 (PRIOR ART)
FIG. 3 is a perspective view illustrating a conventional disconnect switch, such as is depicted by FIG. 1, when a switch blade of the disconnect switch is in an open position.

FIGS. 2 and 3 depict exemplary conventional switches 15. In this regard, FIG. 2 depicts a disconnect switch 15 in the closed position, and FIG. 3 depicts a disconnect switch 15 in the open position. As shown by FIG. 2, the disconnect switch 15 is positioned on multiple insulators 205-207. The insulators 205-207 may comprise ceramic or porcelain coatings or other non-conductive material. The insulators 205-207 sit atop a base 220, which in one exemplary embodiment is composed of steel, although other materials are possible in other embodiments. The base 220 provides support and mechanical stability for the insulators 205-207 and switch 15. Other configurations of the switches 15 are possible.

A support 232 is mechanically coupled to the top of insulator 205. The support 232 has a conductive jaw 240 mechanically coupled at one end of the support 232. The conductive jaw 240 is configured to accept and engage with a conductive switch blade 230. The switch blade 230 resides atop a support 233, which is mechanically coupled to insulators 206 and 207.

The switch blade 230 is composed of conductive material, such as copper or an aluminum alloy, and is mechanically coupled to an end of the support 233 via a hinge 235. The switch blade 230 pivots about the hinge 235 to move from the closed position (as shown by FIG. 2 where the switch blade 230 is engaged with the conductive jaw 240), thereby separating from the jaw 240 as the switch blade 230 rotates. The switch blade 230 may continue to pivot about the hinge 235 until it reaches a vertical open position, as shown by FIG. 3, where the blade 230 is substantially vertical and, thus, rotated about ninety degrees from the closed position. While in the vertical open position, the hinge 235 may be locked by a locking mechanism (not shown) in an effort to prevent the arm 230 from falling and engaging the conductive jaw 240.

Figure 4:
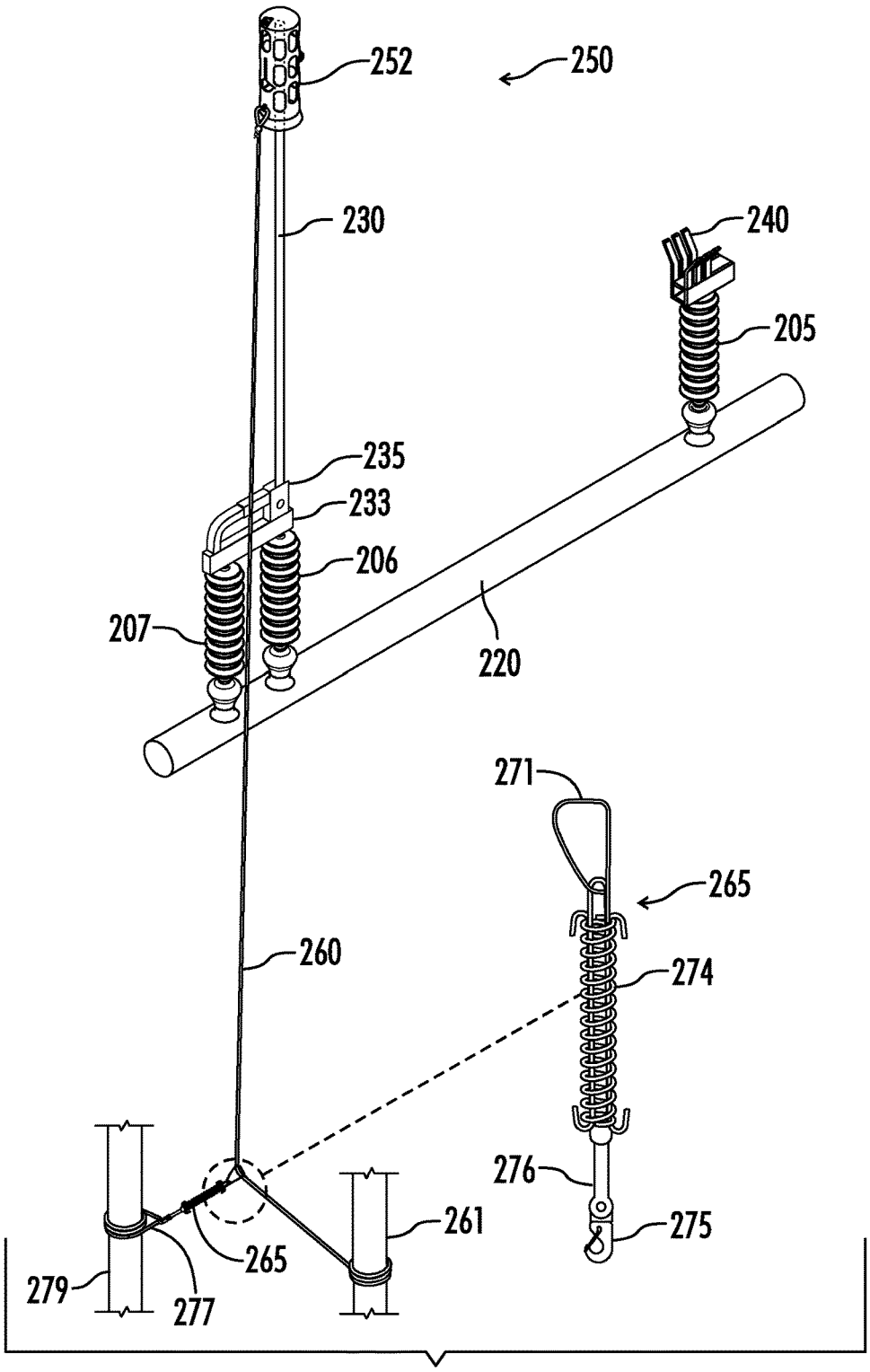
FIG. 4 is a perspective view illustrating an exemplary embodiment of a switch-blade restraint system for use with a disconnect switch, such as is depicted by FIGS. 2 and 3.
Figure 7:
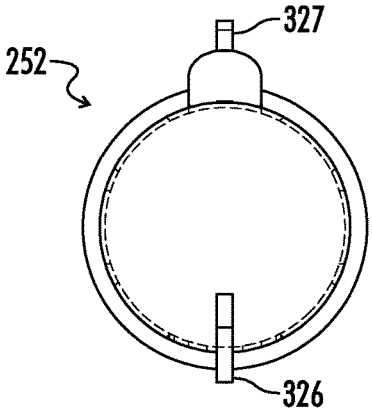
FIG. 7 is a top view of the sheath depicted by FIG. 5.

In one exemplary embodiment, a switch-blade restraint system 250 is employed in connection with the switch blade 230, as shown by FIG. 4, in order to prevent the arm 230 from closing. Referring to FIG. 4, the switch-blade restraint system 250 comprises a hollow sheath 252 that is positioned over an end of the switch blade 230. That is, the end of the switch blade 230 is inserted into a hollow region of the sheath 252 such that the sheath fits over and covers the end of the switch blade 230. In one exemplary embodiment, the sheath 252 is composed of non-conductive material although other materials are possible in other embodiments.

Figure 5:
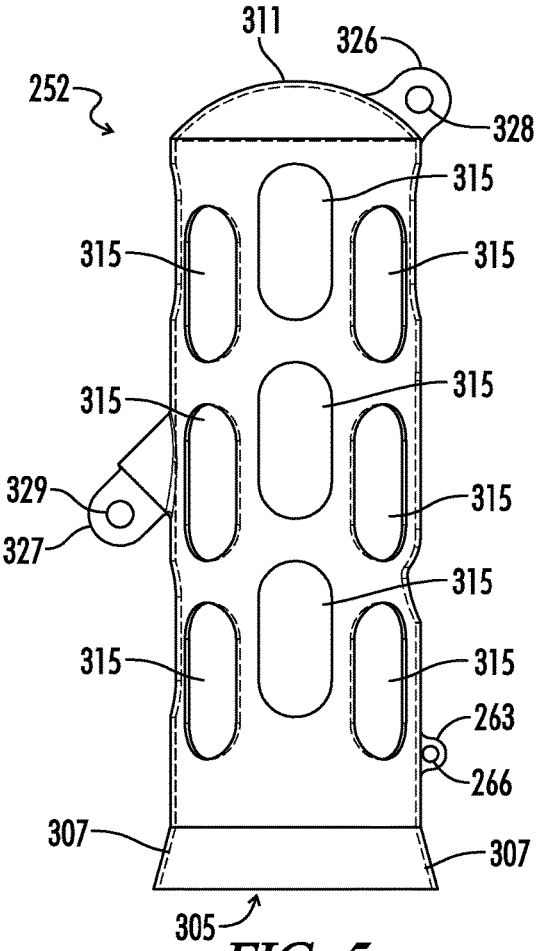
FIG. 5 is a side view of a sheath of a switch-blade restraint system, such as is depicted by FIG. 4.
Figure 6:
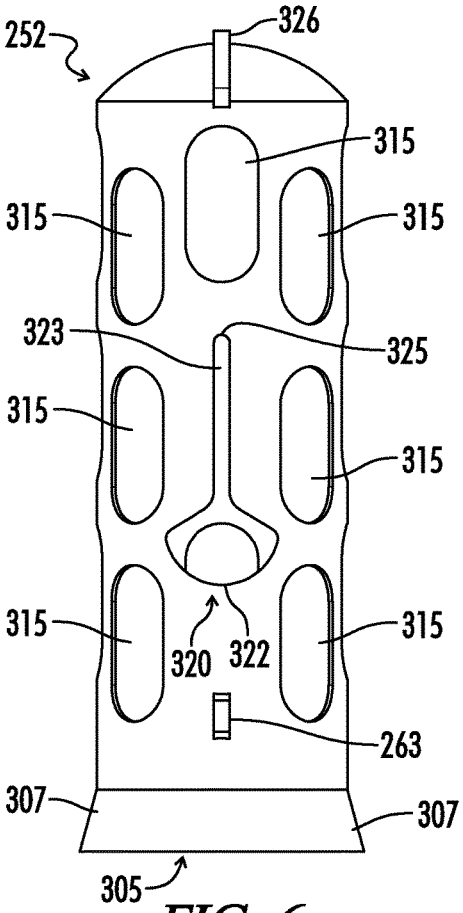
FIG. 6 is a side view of the sheath depicted by FIG. 5 after the sheath has been rotated relative to the view depicted by FIG. 5.
Figure 8:
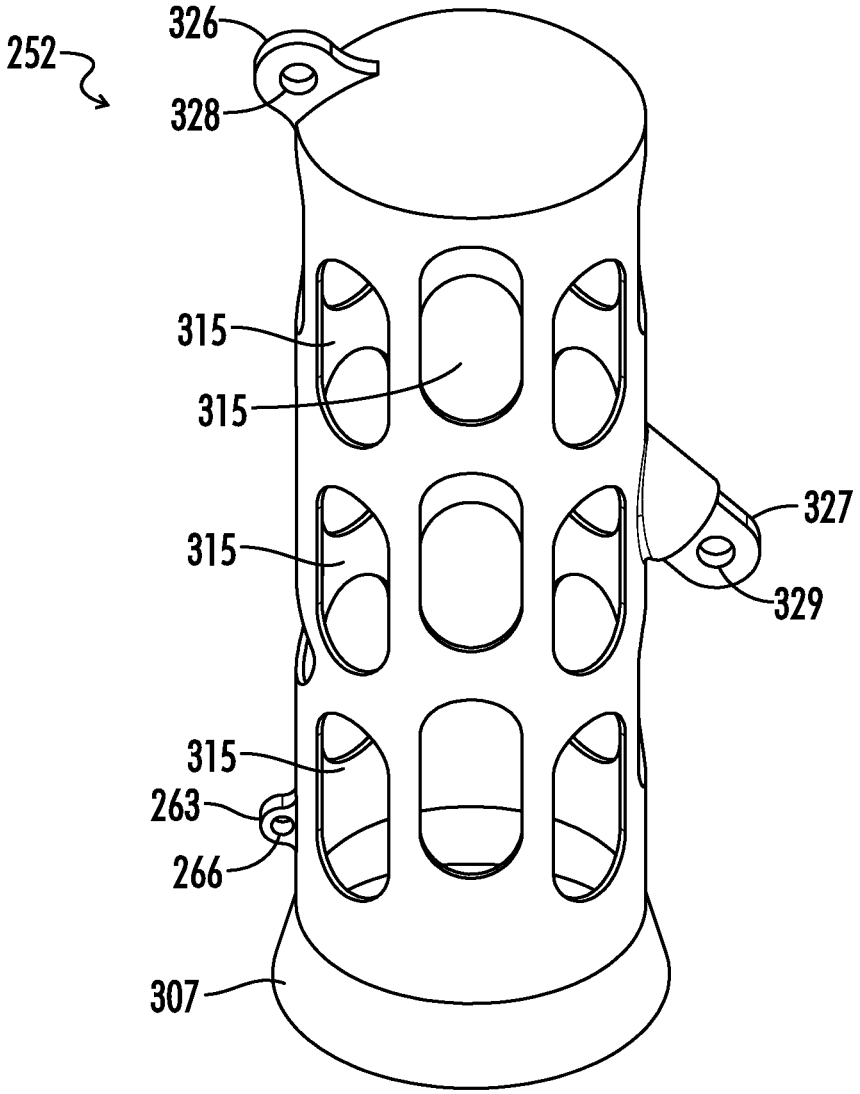
FIG. 8 is a perspective view of the sheath depicted by FIG. 5.

The switch-blade restraint system 250 also comprises a tether 260 (e.g., a rope, cable, or chain) and a tensioner 265. The tether 260 is coupled to the sheath 252 for applying a force that tends to prevent the switch blade from rotating about the hinge 235 toward the jaw 240. In this regard, as shown by FIG. 5, the sheath 252 has a tab 263 extending from a side of the sheath 252, and the tab 263 has a hole 266 through which the tether 260 passes. As an example, the tether 260 may be tied to the tab 263, but other techniques for coupling the tether 260 to the tab 263 are possible in other embodiments.

When positioned on the switch blade 230, the sheath 252 is oriented such that the tab 263 is on a side of the sheath 252 opposite of the jaw 240 so that a horizontal component of the force applied by the tether 260 tends to pull the blade 230 away from the jaw 240 so that the blade 230 is prevented from rotating a significant distance toward the jaw 240. Also, a tensioner 265 is used to remove slack from the tether 260 helping to keep a constant force applied by the tether 260 while the sheath 252 is positioned on the switch blade 230.

In this regard, the tensioner 265 comprises a ratchet loop 271 through which the tether 260 passes. The loop 271 is coupled to a spring 274, which is coupled to a coupling device 275, such as a snap hook, via a shaft 276. The coupling device 275 is coupled to another tether 277 (e.g., a rope, cable, or chain) that is coupled (e.g., tied, fastened, clipped, etc.) to a support 279, such as a post for the base 220. Note that an end of the tether 260 opposite of the sheath 252 may be coupled (e.g., tied, fastened, clipped, etc.) to a structure 261 (e.g., pole, vehicle, equipment, etc.) at the electrical substation 10.

The spring 274 generates a force that tends to pull the tether 260 toward the support 279 thereby removing slack from and increasing tension in the tether 260. Thus, as the switch blade 230 and sheath 252 sway, due to wind or other conditions, the tether 260 constantly applies a force that tends to pull the sheath 260 away from the jaw 240, thereby preventing the jaw 240 from rotating any significant distance toward the jaw 240. Accordingly, accidental closing of the switch blade 230 is prevented.

An exemplary embodiment of the sheath 252 is shown in FIGS. 5-8. In this regard, the sheath 252 forms generally a hollow cylinder having an opening 305 at its bottom end for receiving an end of the switch blade 230. In other embodiments, other shapes and configurations are possible. The lip 307 forming the bottom end of the sheath 252 is tapered helping to facilitate positioning of the sheath 252 on the switch blade 230 by providing a wider area for insertion of the blade 230 through the opening 305. The top end 311 of the sheath 252 forms a rounded dome. When the sheath 252 is positioned on the switch blade 230, an end of the switch blade 230 contacts an inner wall of the rounded end 311 such that the sheath 252 rests on the switch blade 230.

In one exemplary embodiment, the sheath 252 is composed of a non-conductive material, such as a polymer, but other materials may be used in other embodiments. As an example, the sheath 252 may be composed of polyvinyl chloride (PVC), polyethylene, or polypropylene.

The sheath 252 has multiple slots 315. The slots 315 help to reduce the weight of the sheath 252 thereby facilitating placement of the sheath 252 on the switch blade 230. The sheath 252 also has a key-shaped slot 320 that has an elongated portion 323 and a wide portion 322 that is wider than the elongated portion 323. The shape of the slot 320 accommodates a hook at the end of a lineman's pole that can be used to place the sheath 252 on the switch blade 230. In this regard, the hook may be inserted into the slot 320 through the wide portion 322, and the hook may be run along the elongated portion 323 until the hook contacts the sheath wall at a tip 325 of the elongated portion 323. While the sheath 252 is resting on the hook, a user may lift the lineman's pole so that the sheath 252 is moved to the end of the switch blade 230. Once the sheath 252 is positioned over the end of the switch blade 230, the lineman's pole may be lowered so that the hook moves through the elongated portion 323 back to the wide portion 322 where the hook can be removed from the sheath 252.

In one exemplary embodiment, the sheath 252 comprises additional tabs 326 and 327 having holes 328 and 329, respectively, that can be used to raise the sheath to the end of the switch blade 230. In this regard, rather than inserting a hook of a lineman's pole or other device through the slot 320, the hook may instead be inserted through either of the holes 328 or 329. Alternatively, a lifting device, such as a "shotgun stick," may have multiple hooks or other components inserted through multiple holes 328 and 329 in order to help stabilize the sheath 252 during lifting. In other embodiments, yet other techniques and devices for positioning the sheath 252 on the switch blade 230 are possible.

When closing of the switch blade 230 is desired, such as after work at the substation 10 is completed, the hook of the lineman's pole may again be inserted through the slot 320 in a manner similar to that described above so that lineman's pole may be used to manually lift the sheath 252 off of the switch blade 230. After the sheath 252 is removed, the switch blade 230 may be closed in a conventional manner so that the switch blade 230 makes contact with the conductive jaw 240 thereby permitting current to flow through the disconnect switch 15.

The switch-blade restraint system 250 provides a visible confirmation that the switch blade 230 is restrained in the open position and thus is prevented from electrically contacting the conductive jaw 240. Accordingly, inadvertent arcing and closing of the switch blade 230 are prevented as well. The non-conductive sheath 252 may comprise a different color from other components of the disconnect switch 15 in order to provide greater visibility when it is in use.

The various embodiments described herein are exemplary, and various changes and modifications to the embodiments would be apparent to a person of ordinary skill upon reading this disclosure. As an example, the sheath 252 is described above as positioned on an end of the switch blade 230. It is possible for the sheath 252 to be positioned at other locations on the switch blade 230 or for the tether 260 to be coupled to the switch blade 230 without the use of a sheath 252. As an example, the tether 260 may be coupled (e.g., tied, fastened, clipped, etc.) directly to the switch blade 260 or coupled to the switch blade 230 via a device (not shown) other than the sheath 252.

In addition, it is possible to keep the tether 230 permanently coupled to the switch blade 230, even when the switch blade 230 is in the closed position, and to adjust the tension in the tether 260 so that it selectively prevents the switch blade 230 from closing. As an example, the tensioner 265 can be used, as described herein, to keep sufficient tension in the tether 260 for preventing the switch blade 230 from closing. When closing of the switch blade 230 is later desired, the tensioner 265 can be removed from the tether 260 or otherwise adjusted to provide enough slack in the tether 260 for allowing the switch blade 230 to transition to the closed position. In such an embodiment, the tether 260 may be coupled directly to the switch blade 230 without the use of a sheath 252, or the tether 260 may be coupled to the switch blade 230 via the sheath 252, as described above. Alternatively, the tether 260 may be untied or otherwise adjusted or removed from the support to which it is coupled in order to provide sufficient slack for allowing the switch blade 230 to close. Various other techniques for adjusting the tether 260 to permit closure of the switch blade 230 are possible.

The invention claimed is:

1. A system, comprising:

a disconnect switch coupled to a power transmission line at an electrical substation, the disconnect switch having a conductive switch blade and a conductive jaw for receiving the switch blade, the switch blade movable between a closed position and an open position, wherein the switch blade has an end that contacts the conductive jaw when the switch blade is in the closed position such that current from the power transmission line flows through the disconnect switch, and wherein the switch blade is separated from the conductive jaw when in the open position such that current from the power transmission line is prevented from flowing through the disconnect switch;

a removable sheath positioned on the end of the switch blade; and a tether coupled to the removable sheath for preventing the switch blade from transitioning from the open position to the closed position.

2. The system of claim 1, wherein the switch blade is oriented vertically in the open position.

3. The system of claim 1, further comprising a tensioner coupled to the tether.

4. The system of claim 3, wherein the tensioner is spring loaded.

5. A method, comprising:

transitioning a conductive switch blade of a disconnect switch at an electrical substation from a closed position to an open position, the disconnect switch coupled to a power transmission line, wherein an end of the switch blade contacts a conductive jaw when the switch blade is in the closed position such that current from the power transmission line flows through the disconnect switch, and wherein the switch blade is separated from the conductive jaw when in the open position such that current from the power transmission line is prevented from flowing through the disconnect switch; and positioning a sheath on the end of the switch blade while the switch blade is in the open position, wherein the sheath is coupled to a tether such that the tether prevents the switch blade from transitioning from the open position to the closed position.

6. The method of claim 5, further comprising coupling a tensioner to the tether.

7. The method of claim 6, wherein the tensioner is spring loaded.

8. The method of claim 5, further comprising:

removing the sheath from the end of the switch blade; and transitioning the switch blade to the closed position subsequent to the removing.

* * * * *